US007440712B2

(12) United States Patent
Uchida

(10) Patent No.: US 7,440,712 B2
(45) Date of Patent: Oct. 21, 2008

(54) ORIGINAL COVER CLOSER AND OFFICE EQUIPMENT INCLUDING ORIGINAL COVER CLOSER

(75) Inventor: Tayayuki Uchida, Kanagawa (JP)

(73) Assignee: Katoh Electrical Machinery Co., Ltd., Kanagawa (JP)

( * ) Notice: Subject to any disclaimer, the term of this patent is extended or adjusted under 35 U.S.C. 154(b) by 325 days.

(21) Appl. No.: 11/254,270

(22) Filed: Oct. 20, 2005

(65) Prior Publication Data

US 2006/0099007 A1 May 11, 2006

(30) Foreign Application Priority Data

Nov. 11, 2004 (JP) ..... 2004-327724

(51) Int. Cl.
*G03G 15/00* (2006.01)

(52) U.S. Cl. ..... 399/107; 399/362; 399/365; 399/380

(58) Field of Classification Search ..... 399/362, 399/365–380, 107
See application file for complete search history.

(56) References Cited

U.S. PATENT DOCUMENTS

2004/0062583 A1* 4/2004 Kameyama et al. ..... 399/405

FOREIGN PATENT DOCUMENTS

JP 11-95339 4/1999

JP 11-095339 * 4/1999

OTHER PUBLICATIONS

JP 11-095339 English translation.*

* cited by examiner

*Primary Examiner*—Daniel J. Colilla
*Assistant Examiner*—Allister Primo
(74) *Attorney, Agent, or Firm*—Notaro & Michalos P.C.

(57) ABSTRACT

An original cover closer has first and second parts for supporting the cover on a main body of office equipment. The first part supports a heavier side of the cover and a second part supports the lighter side of the cover. Both parts have a mounting member with a bottom plate mounted on the main body and a first supporting member having a top plate and side plates extending downwardly, and rotatably mounted via a hinge pin at respective ends of the mounting member. A first lifting member is mounted via a second hinge pin at respective ends of the top plate so that the first lifting member is rotatable in a reverse direction to the first supporting member. A resilient member rotationally urges the cover in an opening direction by applying force toward the first supporting member and applying force on another end toward the first lifting member. A second lifting member is mounted via a fourth hinge pin at respective ends of the top plate so that the second lifting member is rotatable in a reverse direction with regard to the second supporting member. A torsion spring wound around the fourth hinge pin and rotatably urging the second lifting member toward such direction that it overlaps the second supporting member, by engaging an end on a lower surface of the top plate of the second supporting member and other end on an end surface portion toward the fourth hinge pin of the top plate of the second lifting member. The torsion spring is involved when the second lifting member is rotated in the reverse direction.

3 Claims, 7 Drawing Sheets

ORIGINAL COVER CLOSER AND OFFICE EQUIPMENT INCLUDING ORIGINAL COVER CLOSER

BACKGROUND OF THE INVENTION

1. Field of the Invention

The present invention relates to an original cover closer suitable for use in office equipment such as a copying machine, a printer, a facsimile machine, a scanner, and so on, and office equipment including the original cover closer.

2. Description of the Related Art

The main body of office equipment such as a copying machine, a printer, a facsimile machine, a scanner, and so on has an original cover attached to be rotatable to the top surface of the main body via an original cover closer. The original cover closer is a kind of hinge mechanism which can axially support the original cover to be rotatable around a hinge pin to thereby position the original cover on a contact glass on the top surface of the main body and expose the contact glass. An original can be set on the contact glass by rotating the original cover (moving it upward) to expose (open) the contact glass, mounting the original on the surface of the contact glass, then rotating the original cover in the reverse direction (moving it downward) to bring the original into intimate contact with the top of the contact glass by the original cover.

Such original cover closers include a well-known one in which a lifting member can be provided to bring the original into intimate contact with the contact glass irrespective of the thickness of the original and the urging force of a resilient means can be used to rotate the original cover without making a person feel the weight of the original cover itself (see, for example, the later-described Patent Document). Usually, two original cover closers are provided to support the original cover on the main body of the office equipment to be opened and closed. Use of these two original covers each including the resilient means leads to increased cost as a whole. Hence, in the case where a heavy article such as an original automatic feeder is attached to the original cover to cause the center of gravity of the original cover shift either to the right or to the left, an original cover closer including a resilient means has been used on the side to which the center of gravity has been shifted and an original cover closer including no resilient means has been used on the side opposite to the side to which the center of gravity has been shifted, whereby a significant reduction in cost as a whole has been achieved. The Patent Document is Japanese Patent Application Laid-open No. H11-95339.

Incidentally, in the above-described well-known original cover closer, a second original cover closer supporting the original cover on the side opposite to the side to which the center of gravity is shifted is provided with a lifting member to be able to bring the original into intimate contact with the contact glass irrespective of the thickness of the original, but has a complicated structure. More specifically, the second original cover closer includes a mounting member mounted on a main body of office equipment; a supporting member axially supported to be rotatable on the mounting member; a lifting member overlapping the supporting member, axially supported on a free end of the supporting member, and mounted on the original cover; and a tension coil spring provided between the supporting member and the lifting member, for urging the lifting member in a direction in which the lifting member overlaps the supporting member. One end of the tension coil spring is mounted on the supporting member and the other end thereof is mounted on the lifting member, the supporting member is provided with a guide pin, and the lifting member is provided with a guide groove in an arc-shape into which the guide pin in intruded, so as to urge the lifting member in a direction in which the lifting member overlaps the supporting member, bringing about a problem of the structure being complicated. Another problem is that since the above-described conventional second original cover closer is of a cantilevered type, the original cover tends to swing to the right and the left during the opening and closing operation and thereby has poor stability.

SUMMARY OF THE INVENTION

The present invention has been developed to solve the above problem and its object is to provide an original cover closer which has a simple structure and reduced cost and can increase the stability of the original cover during the opening and the closing to thereby improve its operability, and office equipment including the original cover closer.

To achieve the above object, an original cover closer according to the present invention is characterized in that the first opening/closing part of an original cover for supporting a heavier side of the original cover comprises a first mounting member having a bottom plate mounted on the main body and side plates erected from the both sides of the bottom plate; a first supporting member having a top plate and side plates extending downward from the both sides of the top plate in a direction perpendicular thereto, and rotatably mounted via a first hinge pin at respective end portions on one side of the both side plates to said side plates of said first mounting member; a first lifting member having a top plate for mounting said original cover and both side plates extending downward from the both sides of the top plate in a direction perpendicular thereto and mounted via a second hinge pin at respective end portions on one side of the both side plates to the both sides of the top plate so that the first lifting member is rotatable in a reverse direction with regard to said first supporting member: and a resilient means accommodated between said both side plates of said first supporting member, for rotationally urging the original cover in a direction of opening by applying a force on one end toward said first supporting member and applying a force on other end toward first lifting member, and that the second opening/closing part of an original cover for supporting a lighter side of the original cover comprises a second mounting member having a bottom plate mounted to a main body and both side plates erected from the both sides of the bottom plate, a second supporting member having a top plate and both side plates extending downward from the both sides of the top plate in a direction perpendicular thereto and rotatably mounted via a third hinge pin at respective end portions on one side of the both side plates to the both sides of the top plate, a second lifting member having a top plate for mounting said original cover and both side plates formed by bending both edges of the top plate downward in a direction perpendicular to the top plate and mounted via a fourth hinge pin at respective end portions on one side of the both side plates to the both sides of the top plate so that the second lifting member is rotatable in a reverse direction with regard to said second supporting member, a torsion spring wound around the fourth hinge pin and rotatably urging said second lifting member toward such direction that it overlaps said second supporting member, by engaging an end thereof on a lower surface of said top plate of said second supporting member and other end thereof on an end surface portion toward said fourth hinge pin of said top plate of said second lifting member, and that the torsion spring is so arranged that it is involved when said second lifting member is rotated in said reverse direction.

According to the present invention, the second opening/closing part of the original cover includes the torsion spring which is provided, wound around the second rotation hinge pin, between the second supporting member and the second lifting member, for urging the second lifting member in a direction in which the second lifting member overlaps the second supporting member. Therefore, the urging direction of the torsion spring is in the circumferential direction (including a substantially circumferential direction (hereinafter, sometimes referred only to as the "circumferential direction") which makes it possible to urge the lifting member in the direction in which the lifting member overlaps the supporting member without providing a guide pin and a guide groove in an arc-shape in the supporting member and the lifting member. This results in a simple structure requiring no guide pin and guide groove, leading to further reduction in cost. Further, since the torsion spring urges the second lifting member in the direction in which the second lifting member overlaps the second supporting member, the original cover is hard to swing to the right and the left during the opening and the closing and thereby increased in stability and improved in operability, as compared to the case in which the tension coil spring urges the second lifting member in the direction in which the second lifting member overlaps the second supporting member like the above-described conventional second original cover closer.

In the original cover closer according to the present invention, it is preferable that a spring insertion hole is provided on said top plates of said second lifting member, and it is constituted by a moving insertion portion for receiving one end portion of said torsion spring to be inserted and a contact portion for locking by contact the other end which has been moved within the moving insertion portion.

Further, to achieve the above object, office equipment according to the present invention is characterized by including the original cover closer according to the above-described invention. According to the present invention, the second opening/closing part of the original cover includes, similarly to the above, the torsion spring which is provided, wound around the second rotation hinge pin, between the second supporting member and the second lifting member, for urging the second lifting member in a direction in which the second lifting member overlaps the second supporting member. This results in the second opening/closing part of the original cover which has a simple structure and further reduced cost and can make the original cover hard to swing to the right and the left during the opening and the closing to thereby increase its stability, leading to improved operability.

As has been described, according to the original cover closer and the office equipment according to the present invention, the second opening/closing part of the original cover includes the torsion spring which is provided, wound around the second rotation hinge pin, between the second supporting member and the second lifting member, for urging the second lifting member in a direction in which the second lifting member overlaps the second supporting member. This ensures that the second opening/closing part of the original cover has a simple structure and reduced cost and can increase the stability of the original cover during the opening and the closing to thereby improve its operability.

DETAILED DESCRIPTION OF THE PREFERRED EMBODIMENT(S)

Hereinafter, an original cover closer according to the present invention will be described based on the accompanying drawings.

Figure 1:
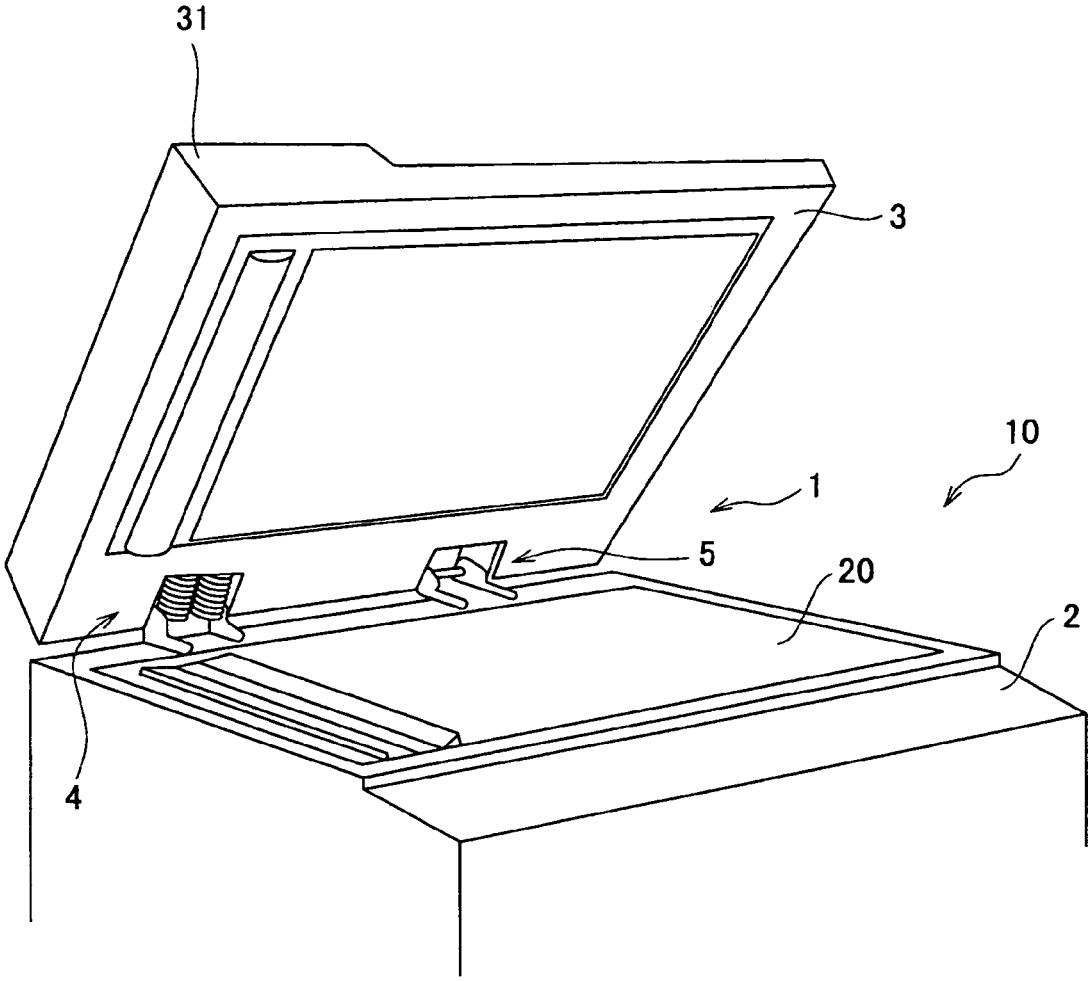
FIG. 1 is a schematic perspective view showing an embodiment of office equipment according to the present invention.
Figure 2:
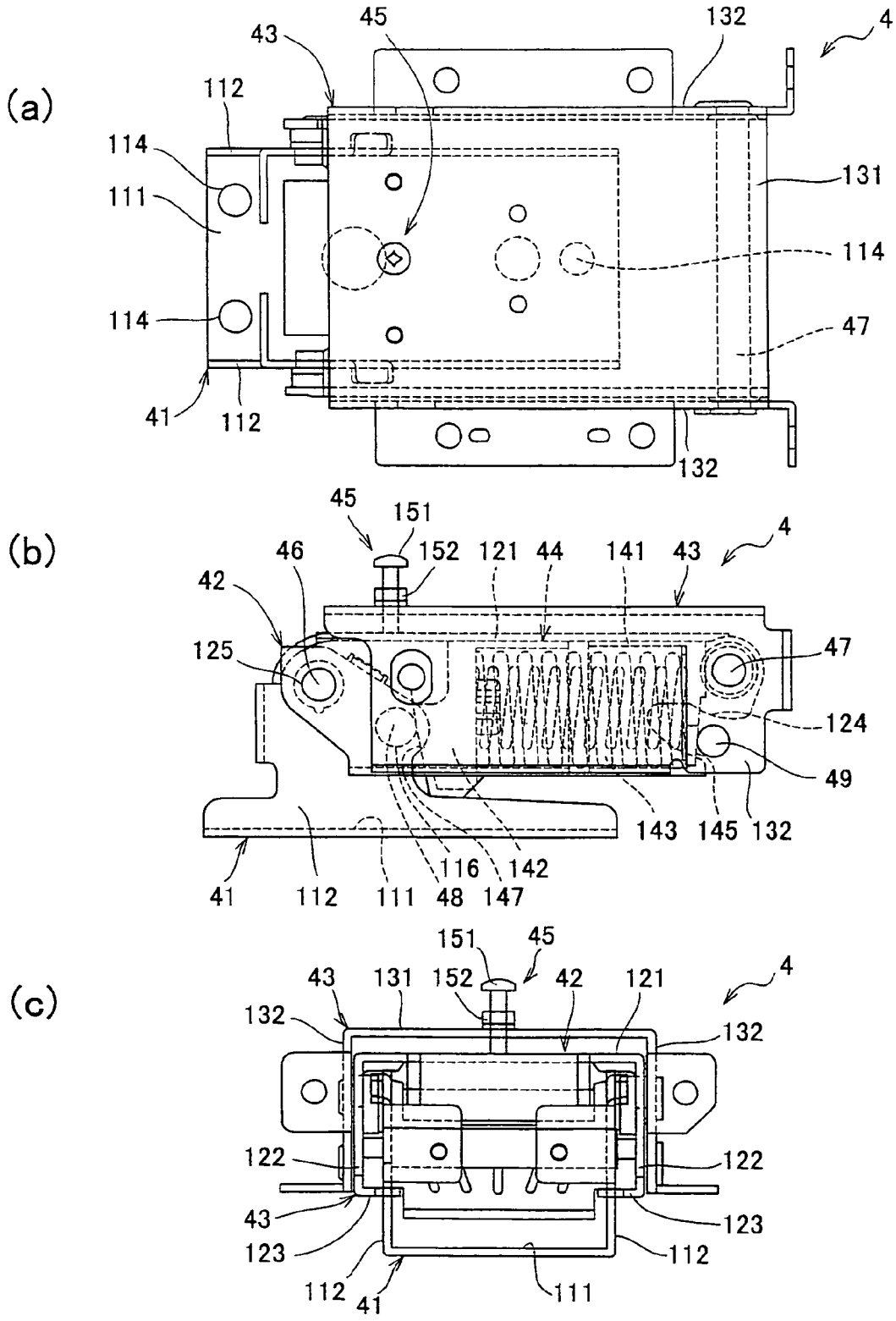
FIGS. 2A to 2C are views showing an embodiment of a first opening/closing part of an original cover according to the present invention, FIG. 2A being a plan view, FIG. 2B being a side view, and FIG. 2C being a front view.
Figure 3:
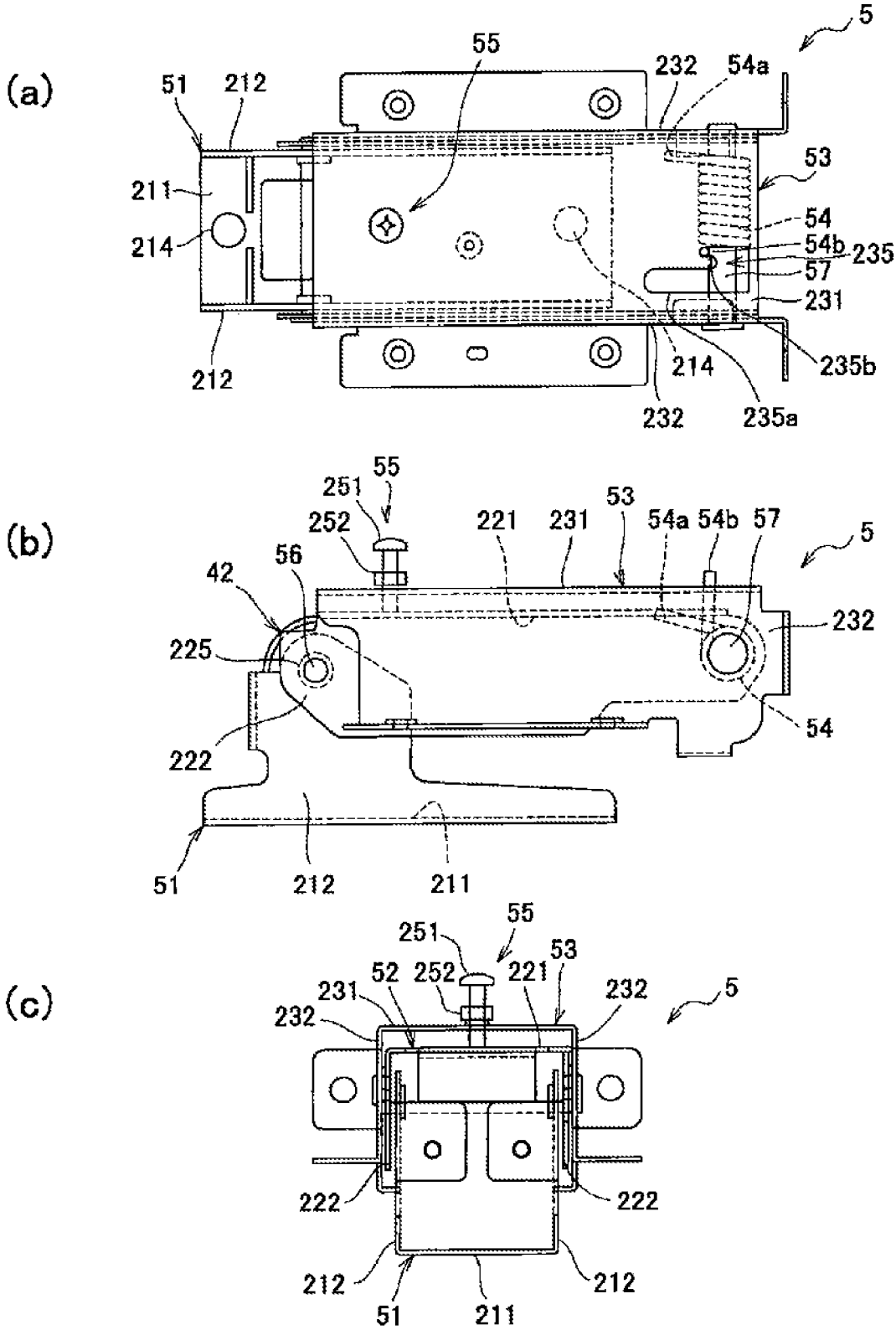
FIGS. 3A to 3C are views showing an embodiment of a second opening/closing part of the original cover according to the present invention, FIG. 3A being a plan view, FIG. 3B being a side view, and FIG. 3C being a front view.

FIG. 1 to FIG. 7 are views showing an embodiment of the original cover closer according to the present invention. The original cover closer according to the present invention, as shown in FIG. 1, attaches an original cover 3 to a rear end portion of a main body 2 of a piece of office equipment 10 to be rotatable with respect to the main body 2, so as to open and close a contact glass 20 at the top surface of the main body 2. Examples of the office equipment 10 includes, but not limited to, a copying machine, a printer, a facsimile machine, a scanner, and so on and, in particular, a copying machine is preferable as the office equipment 10. The original cover 3 has, for example, an original automatic feeder 31 fitted thereto, so that the original cover 3 has an extra weight and a center of gravity shifted either to the right or to the left.

The original cover closer 1 according to the present invention comprises two types of opening/closing parts of the original cover, a first opening/closing part 4 of the original cover and a second opening/closing part 5 of the original cover, which support the original cover 3 having the center of gravity shifted either to the right or to the left to be opened and closed on the main body 2. The first opening/closing part 4 of the original cover supports the original cover 3 on the side where the original automatic feeder 31 is fitted and to which the center of gravity is shifted. The second opening/closing part 5 of the original cover supports the original cover 3 on the side opposite to the side to which the center of gravity is shifted.

The first opening/closing part 4 of the original cover comprises, as shown in FIGS. 2A to 2C, FIG. 4, and FIG. 5, a first mounting member 41 mounted on the main body; a first supporting member 42 axially supported to be rotatable on the first mounting member 41; a first lifting member 43 overlapping the first supporting member 42, axially supported to be rotatable on a free end of the first supporting member 42, and mounted on the original cover 3; and a resilient means 44 provided between the first mounting member 41 and the first supporting member 42, for urging the original cover 3 in a direction of opening it and urging the first lifting member 43 in a direction where the first lifting member 43 overlaps the first supporting member 42.

The first mounting member 41 mainly comprises a bottom plate 111 mounted on the main body 2, and both side plates 112 respectively extending from both side ends of the bottom plate 111 in a direction perpendicular (also including a direction substantially perpendicular) to the bottom plate 111.

The bottom plate 111 is formed in a substantially rectangular shape and formed with a plurality of mounting holes 114 through which machine screws are passed so that the bottom plate 111 is mounted on the main body 2. The side plate 112 is formed in a substantially L-shape together with the bottom plate 111 and provided, at its fore end (upper portion), with a first hinge pin hole (not shown) through which a first hinge pin 46 is inserted. The side plate 112 is provided with a fixing pin hole 116 at a position on the bottom plate 111 side (lower side) of the first hinge pin hole and shifted inward (frontward). A fixing pin 48 is inserted into the fixing pin holes 116 in both the side plates 112. The fixing pin 48 is a pressure bearing member with which a first end of the later-described resilient means 44, that is, the outer surface of a bottom portion of a later-described second slider 142 comes into contact. The pressure bearing member is not limited to the fixing pin 48 or the like, but may be a roller, for example, a pressure bearing roller.

The first supporting member 42 comprises a top plate 121; both side plates 122 respectively extending from both side ends of the top plate 121 in a direction perpendicular (also including a direction substantially perpendicular) to the top plate 121; and guide plates 123 made by bending fore ends of the side plates 122 90° to the sides to face each other.

Both the side plates 122 are provided, at their one ends (rear ends), with second hinge pin holes (not shown) into which a second hinge pin 47 is inserted and provided with notched parts 124 into which a later-described operation pin 49 fits. Both the side plates 122 are provided, at their other ends (front ends), with first hinge pin insertion holes 125. The first hinge pin insertion holes 125 in both the side plates are aligned with the first hinge pin holes in the first mounting member 41, and the first hinge pin 46 is inserted into those pin holes 125, whereby the first supporting member 42 is coupled to the first mounting member 41 to be rotatable around the first hinge pin 46.

The first lifting member 43 is composed of a top plate 131 mounted on the rear end side of the original cover 3 with a screw or the like, and both side plates 132 respectively extending from both side ends of the top plate 131 in a direction perpendicular (also including a direction substantially perpendicular) to the top plate 131 such that the first lifting member 43 is in a substantially U-shape to cover the first supporting member 42. The first lifting member 43 is provided with second hinge pin insertion holes (not shown) at positions on its one end (rear end) and on the top plate 131 side of the center. The first lifting member 43 is also provided with operation pin holes (not shown), into which the operation pin 49 is inserted, at positions on the other end side of the second hinge pin insertion holes and on the side opposite to the top plate 131 side of the center. The operation pin 49 is inserted into and fixed to the operation pin holes in both the side plates 132. The second hinge pin insertion holes in both the side plates 132 of the first lifting member 43 are aligned with the second hinge pin holes in both the side plates 122 of the first supporting member 42, and the second hinge pin 47 is inserted into those holes, whereby the first lifting member 43 and the first supporting member 42 are coupled to be rotatable with respect to each other around the second hinge pin 47.

Further, the top plate 131 is preferably provided, near its rear end, with a horizontal position control means 45 that controls the horizontal position of the original cover 3. The horizontal position control means 45 is composed of, for example, a control screw 151 and a fixing nut 152 which are provided near the rear end of the top plate 131 and at the central portion (including a substantially central portion) in its cross direction. The fixing nut 152 is fixed to the top plate 131, the control screw 151 is screwed to the fixing nut 152, and the tip of the control screw 151 comes into contact with the top plate 121 of the first supporting member 42. The control screw 151 is controlled to control the space between the first supporting member 42 and the first lifting member 43, whereby the horizontal position of the original cover 3 is controlled.

The resilient means 44 rotationally urges the original cover 3 in the direction of opening it, urges the first lifting member 43 in the direction where the first lifting member 43 overlaps the first supporting member 42, and has an urging force to urge the original cover 3 less than the weight of the original cover 3 when the original cover 3 is at a predetermined closing angle or less. The resilient means 44 is composed of, for example, a pair of sliders 141 and 142 which are fitted in the first supporting member 42, and a compression coil spring 143 being an urging member provided in the pair of sliders 141 and 142.

The pair of sliders 141 and 142 are each formed in the shape of sectional rectangular bottomed cylinder. The pair of sliders 141 and 142 are individually slidably fit in the first supporting member 42 such that their opening portions face each other. Between the pair of sliders 141 and 142, the compression coil spring 143 is installed. The pair of sliders 141 and 142 are formed to have lengths which allow them to fit in the first supporting member 42 when the bottom plate 111 of the first mounting member 41 is substantially parallel to the first supporting member 42 (the top plate 121) (for example, when the original cover 3 is brought into intimate contact with the top of the contact glass 20 being the top surface of the main body 2 (at the time of intimate contact of the original cover)).

The number of the compression coil springs 143 is not particularly limited and may be one or two. For example, two compression coil springs 143 are provided side by side to urge the pair of sliders 141 and 142 in directions in which they are divided from each other. The compression coil spring 143 may also be a single compression coil spring 143 in which, for example, a large-diameter coil spring has a small-diameter coil spring located therein. The compression coil spring 143 rotationally urges the original cover 3 in the direction of opening it and has an urging force to urge the original cover 3 less than the weight of the original cover 3 when the original cover 3 is at a predetermined closing angle or less (for example, 20° (including angles around 20°)).

An inclined surface 145 is formed at a closing surface being the outer surface of the bottom portion of the slider (the first slider) 141 on the fore end side. The inclined surface 145 presses the operation pins 49 by means of the urging force of the compression coil spring 143 to overlap the first supporting member 42 and the first lifting member 43 one on the other. More specifically, the urging force of the compression coil spring 143 overlaps or substantially overlaps the top plate 121 of the first supporting member 42 and the top plate 131 of the first lifting member 43 one on the other, with the tip of the control screw 151 in the top plate 131 of the first lifting member 43 in contact with the top plate 121 of the first supporting member 42.

An inclined portion 147 is formed at the outer surface of the bottom portion of the slider (the second slider) 142 on the rear end side. The inclined portion 147 is a portion that comes into contact with the fixing pin 48. More specifically, when the original cover 3 is rotated in a direction to divide the original cover 3 from the main body 2 (upward) around the first hinge pin 46 from the state where the original cover 3 is in intimate contact with the contact glass 20 on the top surface of the main body 2 (the closed position (see FIG. 4)), the portion in contact with the fixing pin 48 slides along the inclined portion 147 and the second slider 142 is pressed by the compression coil spring 143 to slide within the first supporting member 42 toward the rear end to thereby cause the compression coil spring 143 to gradually stretch. When the original cover 3 reaches the maximum usable opening angle (for example, 60° (including angles around 60°) to 70° (including angles around 70°)), the rotation is limited by an original cover rotation limiting mechanism (not shown).

It is preferable that a fluid damper device (not shown) is provided within the compression coil spring 143. The fluid damper device operates such that when the original cover 3 is rotated in the direction of closing, the device decreases the rotation speed of the original cover 3 only at a predetermined closing angle or less (for example, around 10° or less) of the original cover 3. The fluid damper device is, for example, an oil damper device or the like. Not limited to a particular fluid damper device, but any fluid damper device is applicable as long as the device can decrease the rotation speed of the original cover 3 only at the predetermined closing angle or less (for example, around 10° or less) of the original cover 3. The fluid damper device mainly comprises, for example, a cylinder filled with oils like silicon oil and the like; and a piston (not shown) which is movably provided within the cylinder, has a piston rod coupled thereto, and is urged such that the exposure length of the piston rod exposed from the cylinder increases.

The second opening/closing part 5 of the original cover comprises, as shown in FIGS. 3A to 3C, FIG. 6, and FIG. 7, a second mounting member 51 mounted on the main body and having two side plates 212 which are opposed to each other; a second supporting member 52 axially supported to be rotatable on both the side plates 212 of the second mounting member 51 via a first rotation hinge pin; a second lifting member 53 overlapping the second supporting member 52, axially supported to be rotatable on free ends of two side plates 222 of the second supporting member 52, which are opposed to each other, via a second rotation hinge pin, and mounted on the original cover 3; and a torsion spring 54 provided, wound around the second rotation hinge pin, between the second supporting member 52 and the second lifting member 53, for urging the second lifting member 53 in a direction where the second lifting member 53 overlaps the second supporting member 52.

The second mounting member 51 mainly comprises a bottom plate 211 mounted on the main body 2, and both the side plates 212 respectively extending from both side ends of the bottom plate 211 in a direction perpendicular (also including a direction substantially perpendicular) to the bottom plate 211 and opposed to each other. The bottom plate 211 is formed in a substantially rectangular shape and formed with a plurality of mounting holes 214 through which machine screws are passed so that the bottom plate 211 is mounted on the main body 2. The side plate 212 is formed in a substantially L-shape together with the bottom plate 211 and provided at its fore end (upper portion) with a third hinge pin hole (not shown) through which a third hinge pin 56 being the first rotation hinge pin is inserted.

The second supporting member 52 comprises a top plate 221; and both the side plates 222 respectively extending from both side ends of the top plate 221 in a direction perpendicular (also including a direction substantially perpendicular) to the top plate 221 and opposed to each other. Both the side plates 222 are provided, at their one ends (rear ends), with fourth hinge pin holes (not shown) into which a fourth hinge pin 57 being the second rotation hinge pin is inserted. Both the side plates 222 are provided, at their other ends (front ends), with third hinge pin insertion holes 225. The third hinge pin insertion holes 225 in both the side plates 222 are aligned with the third hinge pin holes in the second mounting member 51, and the third hinge pin 56 is inserted into those holes 225, whereby the second supporting member 52 is coupled to the second mounting member 51 to be rotatable via the third hinge pin 56.

The second lifting member 53 is composed of a top plate 231 mounted on the rear end side of the original cover 3 with a machine screw or the like and both side plates 232 respectively extending from both side ends of the top plate 231 in a direction perpendicular (also including a direction substantially perpendicular) to the top plate 231 and opposed to each other such that second lifting member 53 is in a substantially U-shape to cover the second supporting member 52. The second lifting member 53 is provided with fourth hinge pin insertion holes (not shown) at positions on its one end (rear end) and on the top plate 231 side of the center. The fourth hinge pin insertion holes in both the side plates 232 of the second lifting member 53 are aligned with the fourth hinge pin holes in both the side plates 222 of the second supporting member 52, and the fourth hinge pin 57 is inserted into those holes, whereby the second lifting member 53 and the second supporting member 52 are coupled to be rotatable with respect to each other via the fourth hinge pin 57.

Further, the top plate 231 is preferably provided, near its rear end, with a horizontal position control means 55 that controls the horizontal position of the original cover 3. The horizontal position control means 55 is composed of, for example, a control screw 251 and a fixing nut 252 which are provided near the rear end of the top plate 231 and at the central portion (including a substantially central portion) in its cross direction. The fixing nut 252 is fixed to the top plate 231, the control screw 251 is screwed to the fixing nut 252, and the tip of the control screw 251 comes into contact with the top plate 221 of the second supporting member 52. The control screw 251 is controlled to control the space between the second supporting member 52 and the second lifting member 53, whereby the horizontal position of the original cover 3 is controlled.

The torsion spring 54, wound around the fourth hinge pin 57 being the second rotation hinge pin, rotationally urges the second lifting member 53 in the direction where the second lifting member 53 overlaps the second supporting member 52, and has an urging force to urge the original cover 3 less than the weight of the original cover 3 when the original cover 3 is at a predetermined closing angle or less. The torsion spring 54 has one end 54*a* in contact with the lower surface of the top plate 221 of the second supporting member 52 and the other end 54*b* inserted into a spring insertion hole 235 provided in the top plate 231 of the second lifting member 53. The urging force of the torsion spring 54 overlaps or substantially overlaps the top plate 221 of the second supporting member 52 and the top plate 231 of the second lifting member 53 one on the other, with the tip of the control screw 251 in the top plate 231 of the second lifting member 53 in contact with the top plate 221 of the second supporting member 52. The spring insertion hole 235 provided in the top plate 231 of the second lifting member 53 is constituted by a moving insertion portion 235*a* to allow the other end 54*b* of the torsion spring 54 against its urging force to pass from an upper portion to a lower portion of the top plate 231 and a contact portion 235*b* for locking by contact the other end which has been moved within the moving insertion portion, for easy attachment of the torsion spring 54.

Next, operation of the original cover closer 1 according to the present invention will be described.

Figure 4:
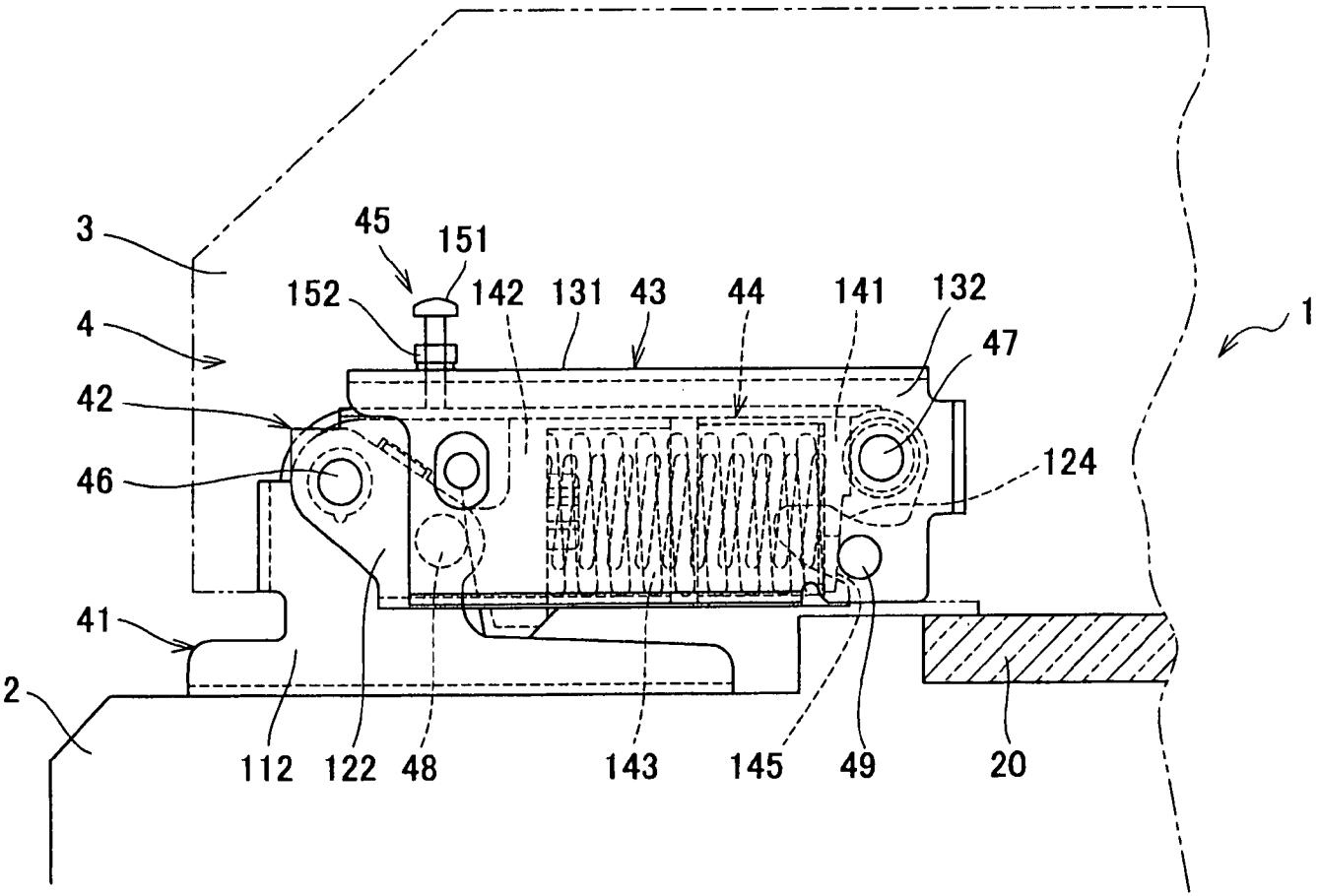
FIG. 4 is a side view showing the embodiment of the first opening/closing part of the original cover according to the present invention.
Figure 6:
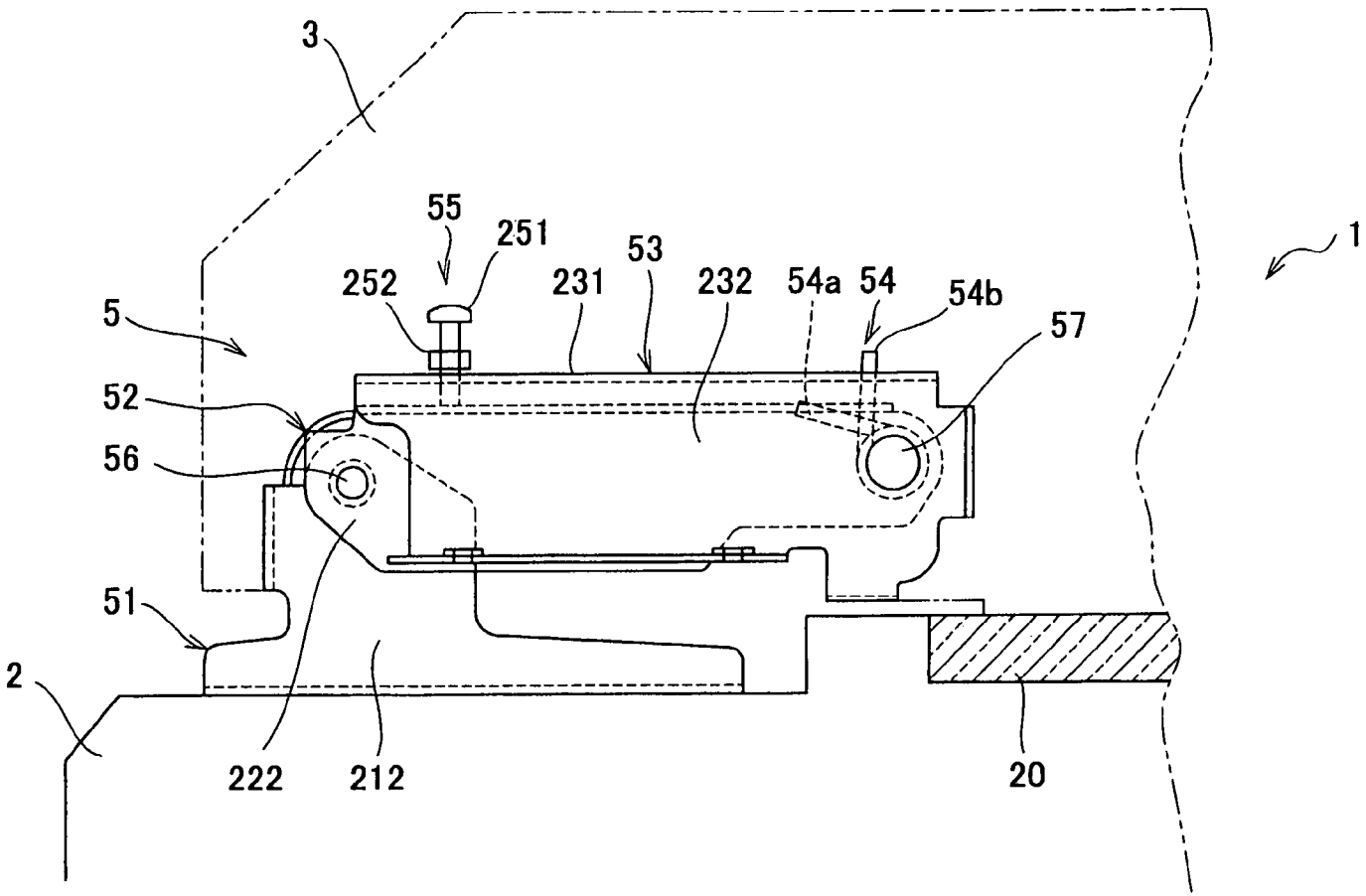
FIG. 6 is a side view showing the embodiment of the second opening/closing part of the original cover according to the present invention.

The original cover 3 in a state where the main body 2 of the office equipment 10 is not in use, as shown in FIG. 4 and FIG. 6, is in intimate contact with the contact glass 20 of the main body 2. To mount an original on the surface of the contact glass 20, the original cover 3 is first lifted upward by gripping a gripping part which is provided at the front (at or near the end on the opposite side to the position where the first opening/closing part 4 of the original cover and the second opening/closing part 5 of the original cover are provided) of the original cover 3. In other words, the original cover 3 is rotated around the first hinge pin 46 and the third hinge pin 56 to thereby expose the contact glass surface. At the time when the original cover 3 is rotated as described above, it is rotated in the direction of opening without making a person feel the weight of the original cover 3 because it is rotationally urged in the direction of opening by the urging force of the compression coil spring 143.

After the original is mounted on the surface of the exposed contact glass 20, the lifted original cover 3 is lowered. In other words, the original cover 3 is rotated in the direction of closing. This causes the original cover 3 to rotate in a direction (downward) in which it comes into contact with the contact glass 20 around the first hinge pin 46 and the third hinge pin 56. In this event, the urging force of the compression coil spring 143 and the urging force of the torsion spring 54 rotate the original cover 3 downward around the first hinge pin 46 and the second hinge pin 56, with the tip of the control screw 151 in the top plate 131 of the first lifting member 43 kept in contact with the top plate 121 of the first supporting member 42 and the tip of the control screw 251 in the top plate 231 of the second lifting member 53 kept in contact with the top plate 221 of the second supporting member 52, that is, without the original cover 3 (the lifting members 43 and 53) being rotated around the second hinge pin 47 and the fourth hinge pin 57.

To rotate the original cover 3 in the direction of closing as described above, a little force is initially required because the rotation is against the urging force of the compression coil spring 143. For example, when the opening angle of the original cover 3 decreases to 20° or less (including angles around 20°), the weight of the original cover 3 is greater than the urging force of the compression coil spring 143, so that the original cover 3 can be easily rotated. In this event, when the opening angle of the original cover 3 decreases to 10° or less (including angles around 10°), the tip of the piston rod of the fluid damper device comes into contact with the inner surface of the bottom surface of the second slider 142. The piston rod then moves into the cylinder, whereby the exposure length of the piston rod is decreased to reduce the rotation speed of the original cover 3. Consequently, the rotation speed of the original cover 3 is controlled by the fluid damper device, thereby preventing the original cover 3 from vigorously colliding against the contact glass 20.

Figure 5:
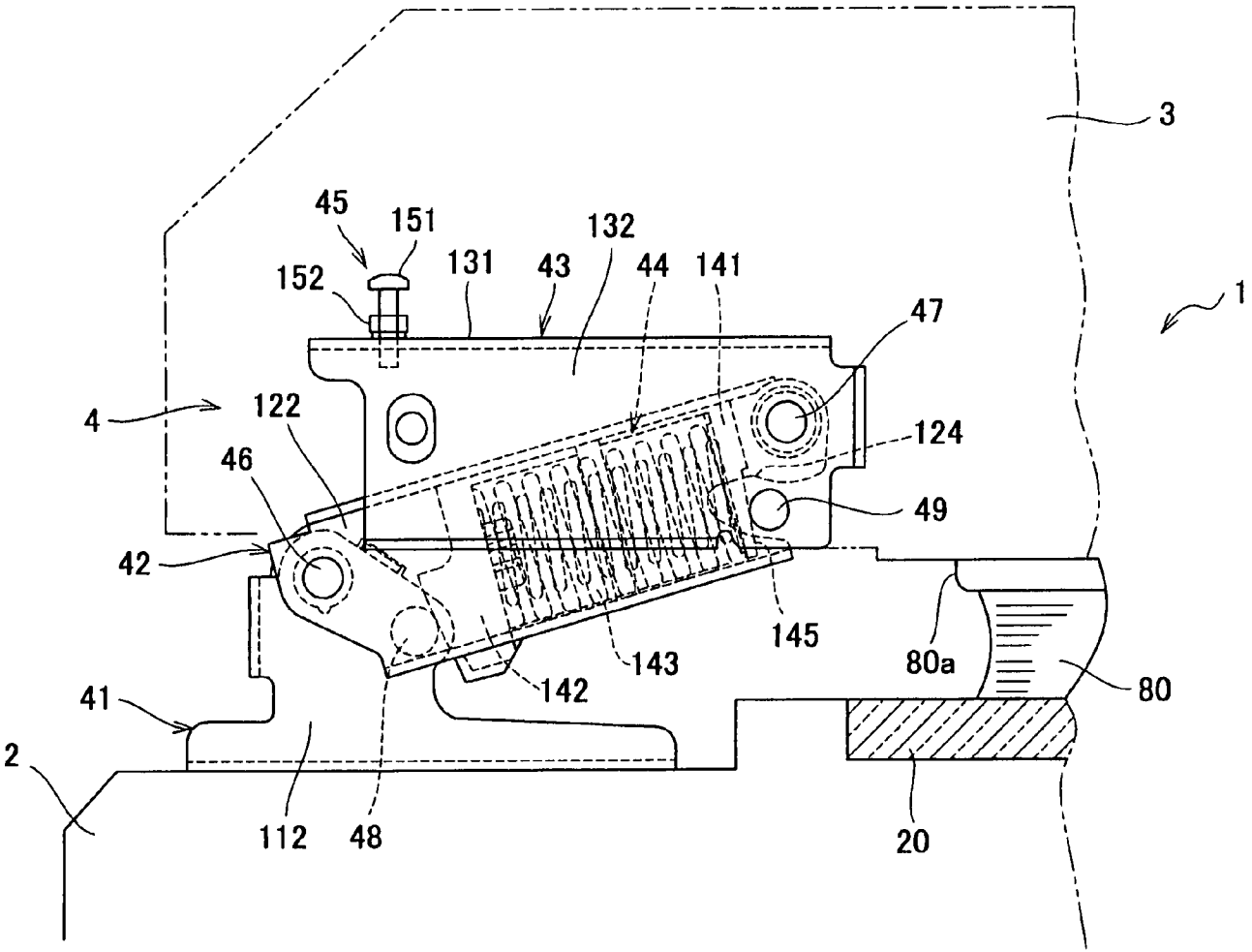
FIG. 5 is a side view showing the embodiment of the first opening/closing part of the original cover according to the present invention.
Figure 7:
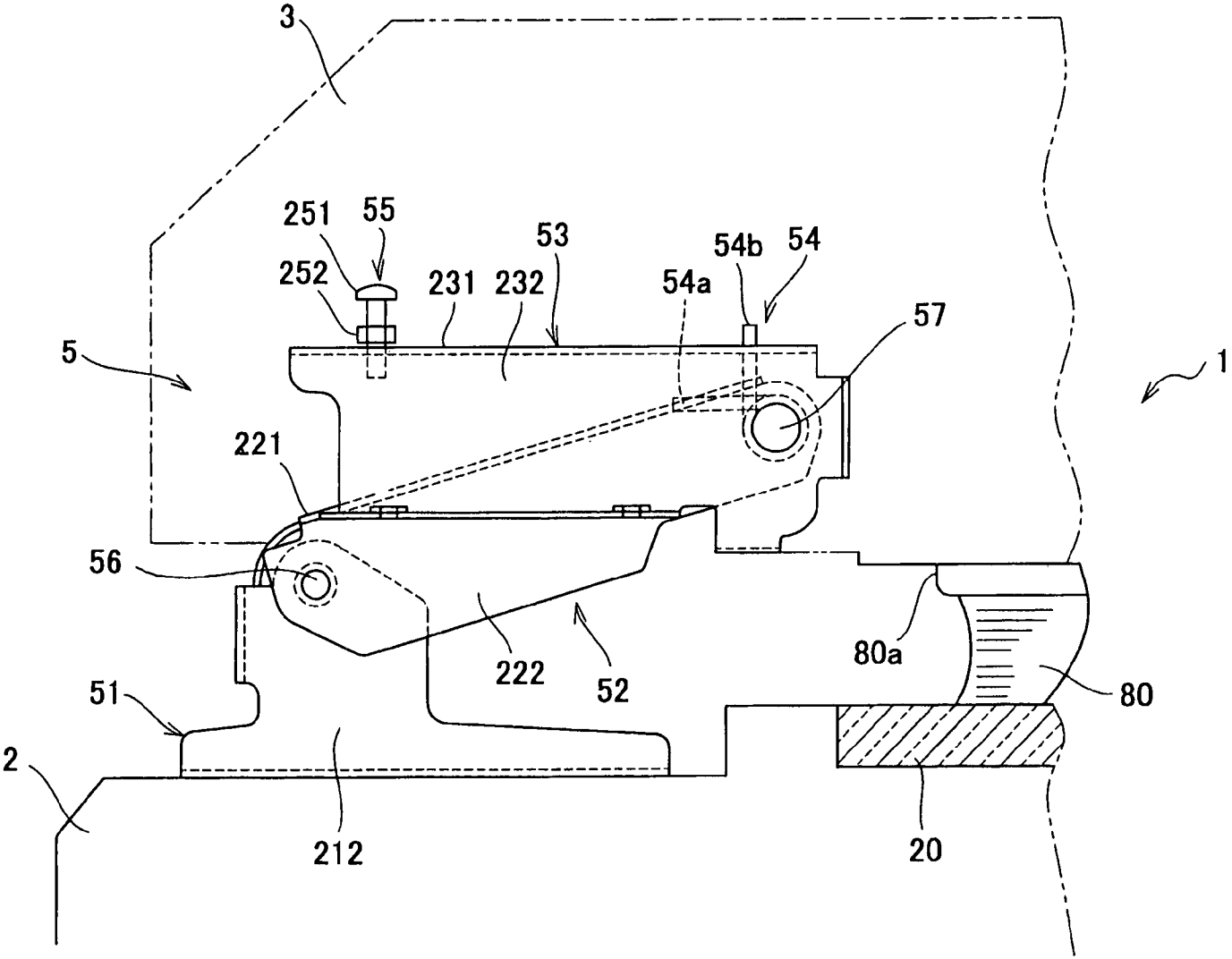
FIG. 7 is a side view showing the embodiment of the second opening/closing part of the original cover according to the present invention.

In the case where the original is thick like a book as shown in FIG. 5 and FIG. 7, when the original cover 3 is rotated (moved downward), a portion of the original cover 3 near the first supporting member 42 and the second supporting member 52 comes into contact with an end portion 80*a* or near that portion of an original 80 on the side of the first supporting member 42 and the second supporting member 52 and thereby forms a space between the original cover 3 and the end of the original 80 on the side opposite to the end on the side of the first supporting member 42 and the second supporting member 52. In short, the original cover 3 on the end on the gripping part side is suspended in the air. When, for example, a portion near the end of the original cover 3 on the gripping part side is pressed toward the contact glass 20, the operation pin 49 presses, climbing the inclined surface 145 of the first slider 141, the first slider 141 toward the second slider 142. This causes the first slider 141 to move toward the second slider 142 side against the urging force of the compression coil spring 143 and the other end 54*b* of the torsion spring 54 to move in the circumferential direction (including a substantially circumferential direction) of the torsion spring 54 against its urging force, whereby the original cover 3 rotates around the second hinge pin 47 and the fourth hinge pin 57. In short, the original cover 3 rotates in a manner to cover the upper portion of the original 80. When the upper portion of the original 80 is, for example, a flat surface, the original cover 3 comes into surface contact with the upper portion. Accordingly, the original 80 having a large thickness will stably come into intimate contact with the surface of the contact glass 20.

When the original 80 is then removed from the top of the contact glass 20 and the original cover 3 is returned to the original position, the operation pin 49 provided at the first lifting member 43 rotating in the clockwise direction descends the inclined surface 145 of the first slider 141 in the illustrated embodiment. This facilitates rotation in the clockwise direction to allow the original cover 3 to be easily returned to the original position, resulting in improved operability of the original cover 3.

As described above, the opening/closing part of the original cover provided with the resilient means 44 is used as the first opening/closing part 4 of the original cover which rotationally supports the original cover 3 on the side to which the center of gravity is shifted due to attachment of a heavy article such as the original automatic feeder 31 thereto, and opening/closing part of the original cover provided with no resilient means is used as the second opening/closing part 5 of the original cover which rotationally supports the original cover 3 on the side opposite to the side to which the center of gravity is shifted, thereby significantly reducing const as a whole. In addition, the second opening/closing part 5 of the original cover includes the torsion spring 54, resulting in a simple structure and further reduction in cost. In other words, the urging direction of the torsion spring 54 is in the circumferential direction, which makes it possible to urge the second lifting member 53 in the direction in which the second lifting member 53 overlaps the second supporting member 52 without providing a guide pin and a guide groove in an arc-shape in the second supporting member 52 and the second lifting member 53. This results in a simple structure requiring no guide pin and guide groove, leading to further reduction in cost.

Further, since the urging force of the torsion spring 54 urges the second lifting member 53 in the direction in which the second lifting member 53 overlaps the second supporting member 52, the original cover 3 is hard to swing to the right and the left during the opening and the closing and thereby increased in stability and improved operability, as compared to the case in which the tension coil spring urges the second lifting member in the direction in which the second lifting member overlaps the second supporting member like the above-described conventional second original cover closer.

Accordingly, the original cover closer 1 according to the present invention can be made simple in structure and reduced in cost, and can increase the stability of the original cover 3 during the opening and the closing to thereby improve its operability as well as stably bring the original into intimate contact with the main body 2 irrespective of the thickness of the original.

Further, the horizontal position control means 45 and 55 are provided on the first lifting member 43 and the second lifting member 53, thereby making it possible to control the position of the original cover 3 with respect to the contact glass 20 to bring the original into intimate contact with the contact glass 20 with more stability.

Although the case in which the second slider 142 is used has been described in the above embodiment of the present invention, the object of the present invention can be achieved even if the second slider 142 is replaced with a spring bearing member in a known configuration swingably attached to the operation pin 49.

Further, since the office equipment 10 according to the present invention includes the above-described original cover closer 1 according to the present invention, the second opening/closing part 5 of the original cover includes, as described above, the torsion spring 54 which is provided, wound around the fourth hinge pin 57, between the second supporting member 52 and the second lifting member 53, for urging the second lifting member 53 in a direction in which the second lifting member 53 overlaps the second supporting member 52. This results in the second opening/closing part 5 of the original cover which has a simple structure and further reduced cost and can make the original cover 3 hard to swing to the right and the left during the opening and the closing to thereby increase its stability, leading to improved operability.

As has been described, the original cover closer according to the present invention has a simple structure and reduced cost and can increase the stability of the original cover during the opening and the closing to thereby improve its operability as well as bring the original into intimate contact with the main body irrespective of the thickness of the original. Therefore, the original cover closer according to the present invention is preferably used, in particular, as the original cover closer of office equipment such as a copying machine, a printer, a facsimile machine, a scanner, and so on.

What is claimed is:

1. An original cover closer comprising:

two types of opening/closing parts comprising a first opening/closing part of an original cover and a second opening/closing part of an original cover, the two types of the opening/closing parts supporting the original cover on a main body of an office equipment, the original cover having a center of gravity either to a right of center or to a left of center of the original cover;

said first opening/closing part of an original cover for supporting a heavier side of the original cover and comprising a first mounting member having a bottom plate mounted on the main body and side plates erected from both sides of the bottom plate; a first supporting member having a top plate and side plates extending downward from both sides of the top plate in a direction perpendicular to the top plate, and rotatably mounted via a first hinge pin at respective end portions on one side of the both side plates to said side plates of said first mounting member; a first lifting member having a top plate for mounting said original cover and both side plates extending downward from both sides of the top plate in a direction perpendicular to the top plate and mounted via a second hinge pin at respective end portions on one side of the both side plates to the both sides of the top plate so that the first lifting member is rotatable in a reverse direction with regard to said first supporting member; and resilient means accommodated between said both side plates of said first supporting member, for rotationally urging the original cover in a direction of opening by applying a force on one end toward said first supporting member and applying a force on another end toward first lifting member;

said second opening/closing part of an original cover for supporting a lighter side of the original cover and comprising a second mounting member having a bottom plate mounted to the main body and both side plates erected from both sides of the bottom plate, a second supporting member having a top plate and both side plates extending downward from both sides of the top plate in a direction perpendicular to the top plate and rotatably mounted via a third hinge pin at respective end portions on one side of the both side plates to the both sides of the top plate, a second lifting member having a top plate for mounting said original cover and both side plates formed by bending both edges of the top plate downward in a direction perpendicular to the top plate and mounted via a fourth hinge pin at respective end portions on one side of the both side plates to the both sides of the top plate so that the second lifting member is rotatable in a reverse direction with regard to said second supporting member, a torsion spring wound around the fourth hinge pin and rotatably urging said second lifting member toward a direction that it overlaps said second supporting member, by engaging an end of the second lifting member on a lower surface of said top plate of said second supporting member and another end of the second lifting member on an end surface portion toward said fourth hinge pin of said top plate of said second lifting member; and wherein the torsion spring is arranged so that the torsion spring is active and involved when said second lifting member is rotated in said reverse direction.

2. An original cover closer according to claim 1, wherein a spring insertion hole is provided on said top plates of said second lifting member, and the spring is constituted by a moving insertion portion for receiving one end portion of said torsion spring to be inserted and a contact portion for locking by contact the other end which has been moved within the moving insertion portion.

3. Office equipment comprising the original cover closer according to claim 1.

* * * * *